United States Patent [19]

Lundberg

[11] 4,352,218

[45] Oct. 5, 1982

[54] MOBILE CHAIR

[76] Inventor: Lars Lundberg, Box 28, Fjällbacka, Sweden, 45071

[21] Appl. No.: 86,148

[22] Filed: Oct. 18, 1979

[51] Int. Cl.[3] ..... B63B 29/00

[52] U.S. Cl. ..... 114/363; 248/425

[58] Field of Search ..... 9/7; 297/349, 430, 241, 297/240, 314; 114/39; 248/415, 416, 425, 429

[56] References Cited

U.S. PATENT DOCUMENTS

| | | | |
|---|---|---|---|
| 149,913 | 4/1874 | Blakey | 9/7 |
| 184,031 | 11/1876 | Blakeman, Jr. | 9/7 |
| 392,867 | 12/1888 | Kerns | 9/7 |
| 1,741,784 | 12/1929 | Lucas | 248/425 |
| 2,396,511 | 3/1946 | Issigonis | 248/429 |
| 2,643,628 | 6/1953 | Sveinsson | 9/7 |
| 3,151,910 | 10/1964 | Larson | 9/7 |
| 3,718,365 | 2/1973 | Gibson | 9/7 |
| 3,993,280 | 11/1976 | Surbaugh | 248/416 |

*Primary Examiner*—Robert J. Spar
*Assistant Examiner*—Kenneth Noland
*Attorney, Agent, or Firm*—Cantor and Singer

[57] ABSTRACT

A mobile chair for use i.e. by handicapped persons, for instance in a boat, comprises a seat and a foot-rest, and is slidable along guide rails and rotatable about a trunnion mounting the foot-rest at a base plate. The seat is carried by an arcuate guide, which in one embodiment has an extension of at least 180° and is carried by guide rails above the foot-rest. In another embodiment the guide can have a full annular extension, and is then carried by supports from a base plate, slidable along two guide rails.

6 Claims, 6 Drawing Figures

MOBILE CHAIR

BACKGROUND OF THE INVENTION

The present invention refers to a mobile chair, in the first hand adapted for used by handicapped persons in sail-boats, where it is essential for the person handling the sails to be able to move forwards and aftwards, and also rapidly to shift position from port to starboard, and vice versa. The invention is however not limited to this field of use, but may be used also in other surroundings, for instance at a working machine. The aim of the invention is thus to provide a mounting for the chair permitting movement forwards and back, as well as permitting a rotational movement of at least a half turn in arbitrary forward/aft position.

SUMMARY OF THE INVENTION

A chair according to the invention comprises a seat and a foot-rest and is characterized in a base plate displaceable along at least one guide rail at a support, a vertical trunnion for pivotably mounting the foot-rest at the base plate and an arcuate guide carrying the seat and being concentric with the trunnion, having an extension of at least 180°, and being movable together with the base plate and means for mounting the seat upon said arcuate guide for sliding movement thereupon.

The chair may be supported by three parallel guide rails, of which a middle one is arranged to carry the base plate, and the sideward ones are mounted at a higher level than the middle one, the arcuate guide being carried by said sidewards guide rails for axial displacement thereon, and the seat being mounted upon said guide by sliding members permitting a rotational movement with respect to the trunnion.

The arcuate guide preferably has an extension of about 220°, a pair of sliding members being provided at each sideward guide rail for carrying the arcuate guide, each of said pair of sliding members being mounted about symmetrically with respect to an immaginary diameter at the arcuate guide normal to the guide rails.

Alternatively the base plate may be provided with rollers for movement along two parallel guide rails. A full annular guide, concentric with the trunnion, and adapted to carry the seat is then carried by supports from the base plate.

The wheels carrying the base plate are preferably provided with peripheral grooves for cooperation with the guide rails and a support rail is mounted parallel with and above each guide rail.

In a boat having a fore and aft running well and thwarts located sidewards thereof, the arcuate guide preferably has a diameter permitting the seat to be swung to positions above either thwart.

Brakes operable from the seat are preferably fitted to lock the seat in relation to the arcuate guide and the foot-rest in relation to its rail, or rails, respectively.

DESCRIPTION OF TWO PREFERRED EMBODIMENTS

Figure 1:
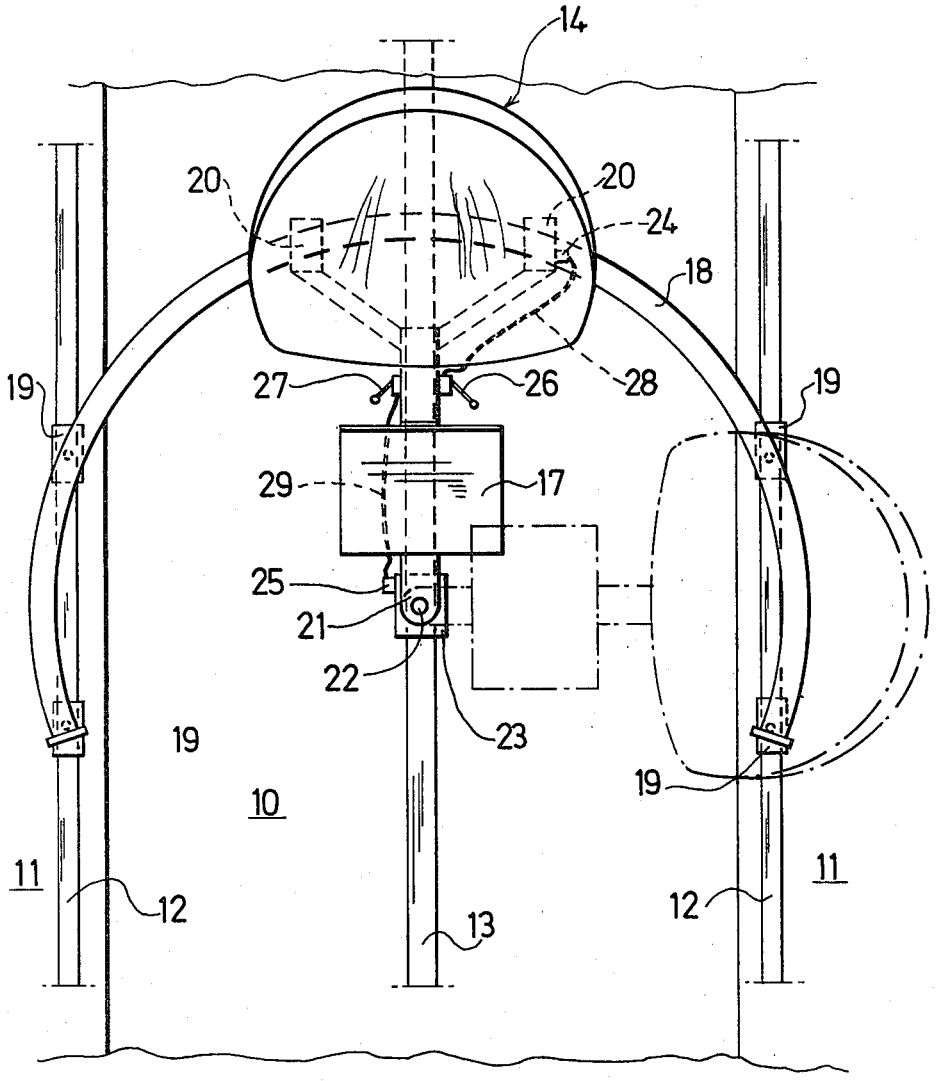
FIG. 1 shows a plan view of part of a well in a sail-boat provided with a chair according to a first embodiment of the invention.
Figure 2:
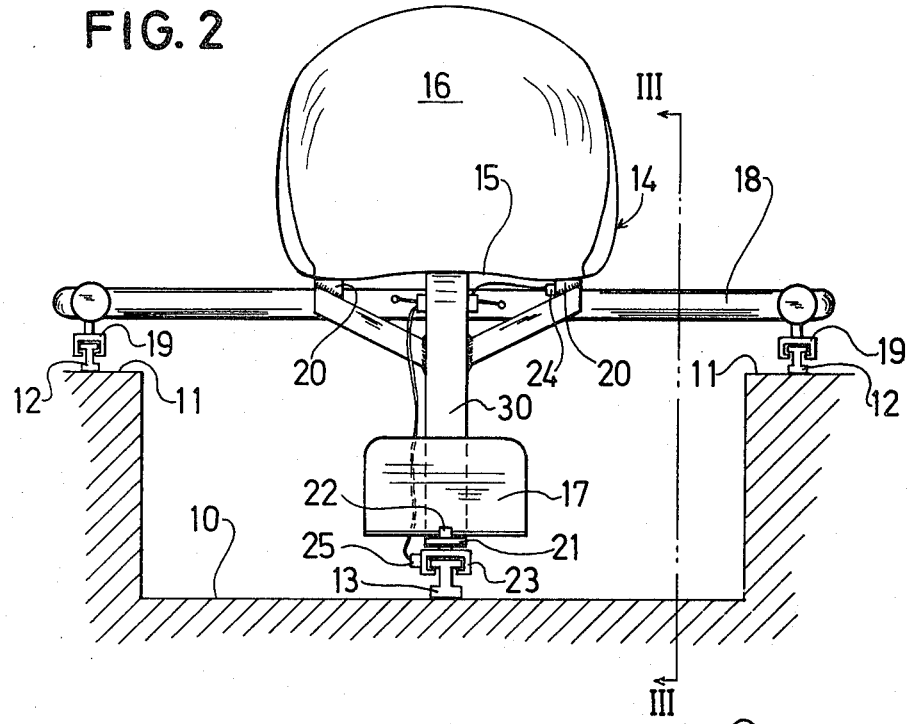
FIG. 2 shows a front view of the chair.
Figure 3:
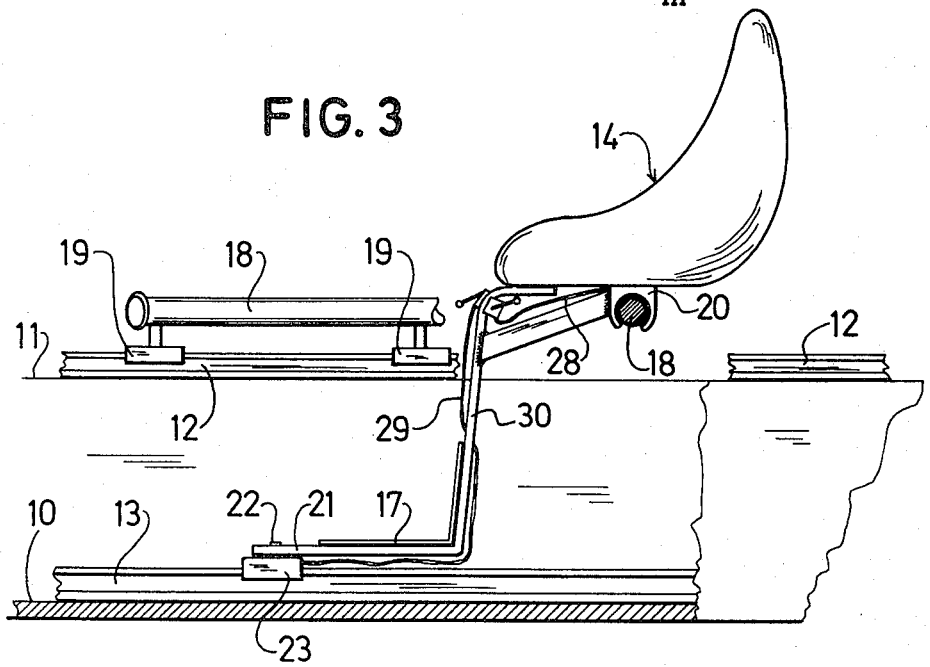
FIG. 3 shows a side view of the chair.

FIGS. 1–3 show a chair as fitted in a sail-boat to be operated by a handicapped person. The shape and the dimensions of the well may vary depending upon the type and size of the boat, and in FIG. 2 the well is schematically defined by a floor 10 and two longitudinal thwarts 11. A longitudinally running guide rail 12 is provided at each of the thwarts, and a third guide rail 13 is located centrally upon the floor, and parallel to the two first mentioned guide rails.

The cross sections of the guide rails may vary to suit various conditions, and the rails may be sunk below the surfaces of the thwarts and of the floor, respectively.

A chair 14 is axially displaceable along guide rails 12 and 13, and comprises a seat 15 with back-rest 16 and a foot-rest 17. The arrangement is made to suit handicapped persons and the shape may vary within wide limits to meet different demands. The seat may thus, for instance, be provided with a safety belt.

Beside the axial movement it is also necessary to provide means permitting the seat to be shifted at least 180° to positions above either of the thwarts. To that end the seat is in the first hand carried by an arcuate guide 18 which, as shown, has an extension of about 220°. Each end of the arcuate guide rests upon a pair of sliding members 19, which are displaceable along guide rails 12. The sliding members 19 of each pair are fitted about symmetrically with respect to an imaginary diameter to the arcuate guide, normal to the guide rails.

The arcuate guide may thus be displaced from one end of the well to the other, along guide rails 12. The overhung portion of guide 18 between guide rails 12 may be reinforced in any suitable manner, not shown.

The seat 14 is carried by two sliding members 20 at the arcuate guide 18 and may be swung along the latter from a position at one thwart to a position at the other thwart, in arbitrary position along guide rails 12.

The foot-rest 17, which may be provided with means (not shown) for adjusting its foot supporting surface to an individually suitable height is rigidly connected to the seat 14 by a back-stay 30, and is terminated by a plate 21. This is pivotably mounted at a trunnion 22, projecting from a base plate 23, which is slidably mounted upon the central guide rail 13 at floor 10. The foot-rest is arranged in such a manner, that trunnion 23 will be located at the center of the arc formed by guide 18.

The sliding members may be shaped in various ways, but should be designed so they, in cooperation with the guide rails, will prevent an unintentional sliding of the chair off its guide and rails. The member may thus be formed as a stool covered by antifriction material, or as a trolley running on balls.

In order to lock the chair in arbitrary positions there is a first brake 24 cooperating with the guide rail, and a second brake 25 cooperating with the central guide rail 13.

The brakes are preferably of the type being spring loaded towards locking position, and are operable by means of hand levers 26, 27. The movement is in a well known manner transferred by way of Bowden cables 28, 29, and will temporarily remove the spring load to permit the desired movement, axially, and/or rotationally.

Figure 4:
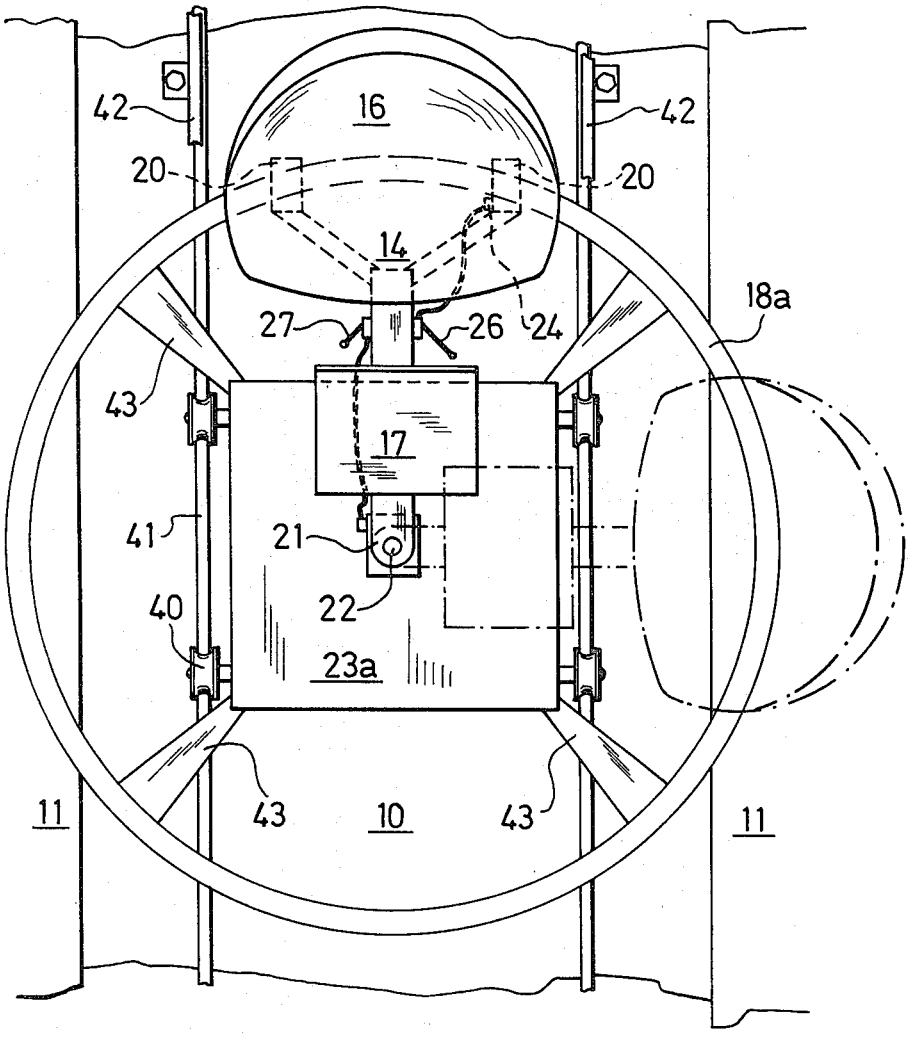
FIGS. 4–6 show similar views of a chair according to a modified embodiment.
Figure 5:
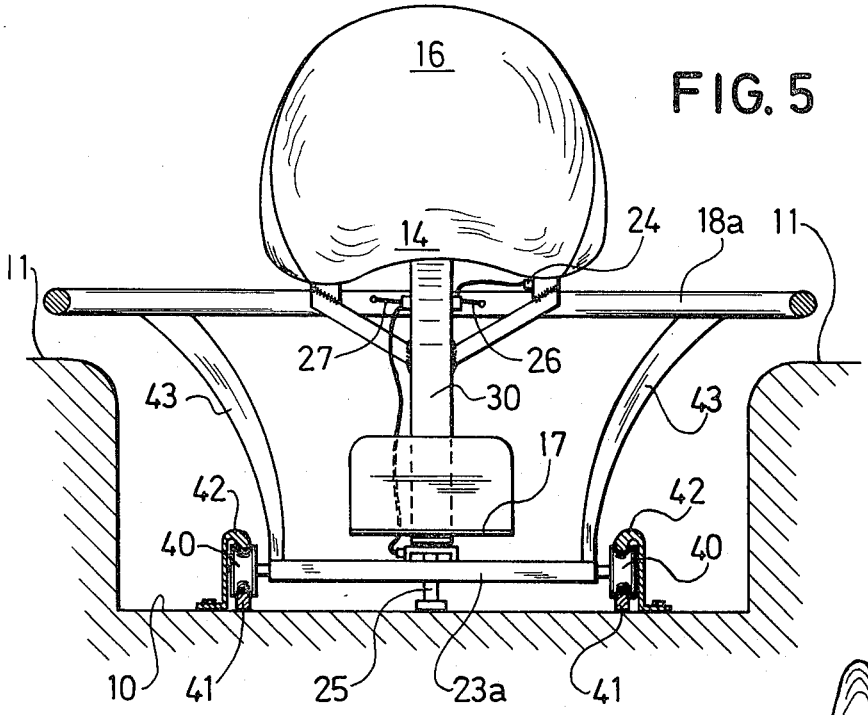
Figure 6:
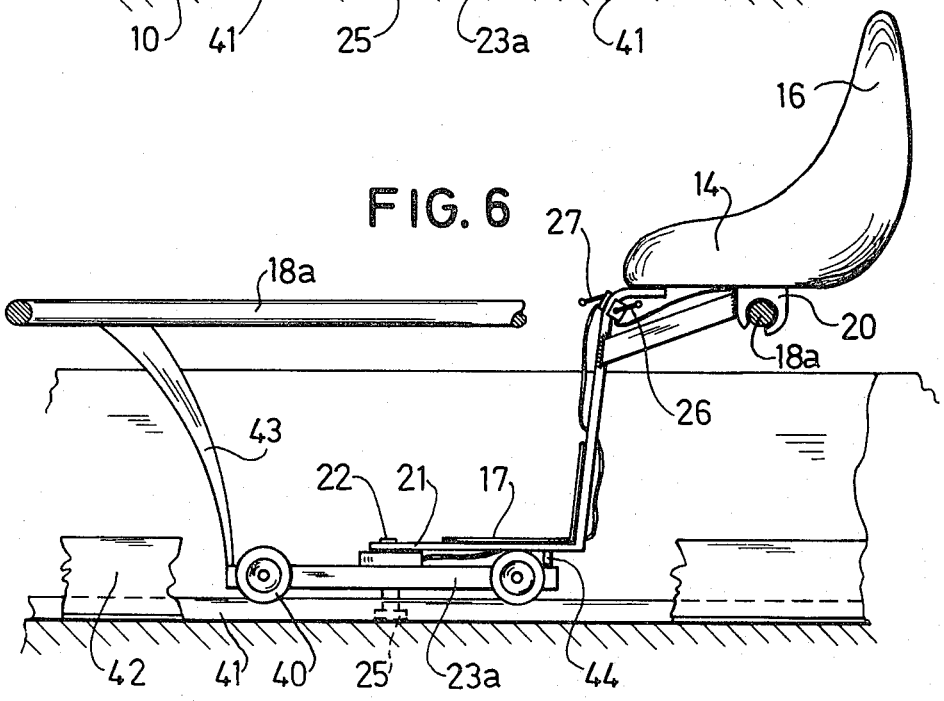

The embodiment shown in FIGS. 4–6 is operable in basically the same manner, and the same reference numerals are used whenever applicable.

The well is defined by a floor 10 and two thwarts 11, and the chair comprises a seat 14 connected to a foot-rest 17 by a back-stay 30. A plate 21 at the foot-rest 17 is by a trunnion 22 connected to a base plate 23*a*, which here is much bigger than in the previous embodiment. The base plate 23*a* is provided with a number of grooved wheels 40 running along two parallel guide rails 41 at the floor. A support rail 42 runs parallel to each guide rail 41 a suitable distance above the same to safely retain the wheels in position at the latter.

The guide 18*a* carrying the seat by way of the sliding members 19 is here annular, i.e. it extends over a full circle, and is carried by supports 43. The latter are fitted at the corners of base plate 23*a* and do not hamper the movements thereof and do not reach to the thwarts 11.

The foot-rest 17 may be provided with a sliding support 44 acting against the top face of base plate 23*a*. Persons suitable for this type of exercise are those having weak legs, and the annular arc 18*a* will together with its supports 43 form a favourable guard for the legs. Those persons often have strong arms and the guide will provide a good hand-grip for the pivotal movement about trunnion 22.

The embodiments shown are examples only, the details of which may vary within the scope of the appended claims depending upon the environments in which the chair is to be used.

What I claim is:

1. A mobile chair as used in a boat having a fore and aft running well and thwarts located sidewards thereof and having a seat and a foot-rest and further comprising:

two parallel guide rails mounted longitudinally at said well, a base plate having means for displacement along said guide rails, a vertical trunnion for pivotably mounting said foot-rest at said base plate, an arcuate guide, concentric with said trunnion and having a full annular extension, means for carrying said arcuate guide freely suspended above said base plate and permitting movement together with the same in the direction of said guide rails, and a back-stay directed away from said base plate and having means for mounting said seat upon said arcuate guide for sliding movement thereupon, said arcuate guide having a diameter permitting the seat to be swung to positions above either thwart.

2. The mobile chair according to claim 1, in which said displacement means are wheels carrying the base plate, said wheels having peripheral grooves for cooperation with said guide rails, as well as with a support rail mounted parallel with, and above, each of said guide rails.

3. A mobile chair having a seat and a foot-rest and further comprising three parallel guide rails for mounting at a support structure, a base plate having means for displacement along the middle guide rail, the two side guide rails being mounted at the support structure at a higher level than said middle guide rail, a vertical trunnion for pivotably mounting said foot-rest and seat at said base plate, an arcuate guide carried by said sideward guide rails for axial displacement thereon, concentric with said trunnion and defining an arc of at least 180°, means connecting said arcuate guide with said base plate for movement together with the same in the direction of said guide rails, further means for mounting said seat upon said arcuate guide for sliding movement thereupon.

4. The mobile chair according to claim 3, in which said arcuate guide has an extension of about 220°, and a pair of sliding members are provided at each of said sideward guide rails for carrying said arcuate guide, each of said pair of sliding members being mounted about symmetrically with respect to an immaginary diameter at said arcuate guide, normal to said guide rails.

5. The mobile chair according to claim 3, as used in a boat having a fore and aft running well and thwarts located sidewards thereof, in which said arcuate guide has a diameter permitting the seat to be swung to positions above either thwart.

6. The mobile chair according to claim 3, further including brakes operable from said seat and adapted to lock the seat in relation to said arcuate guide, and the foot-rest in relation to said support structure carrying said parallel guide rails, respectively.

* * * * *